US007434635B2

(12) United States Patent
Simmons et al.

(10) Patent No.: US 7,434,635 B2
(45) Date of Patent: Oct. 14, 2008

(54) TIN SEAT FOR ROCK DRILL INSERT

(75) Inventors: Rob A. Simmons, Arlington, TX (US); Matthew Floyd Shofner, Mansfield, TX (US)

(73) Assignee: Sandvik Intellectual Property AB, Sandviken (SE)

( * ) Notice: Subject to any disclaimer, the term of this patent is extended or adjusted under 35 U.S.C. 154(b) by 166 days.

(21) Appl. No.: 11/463,981

(22) Filed: Aug. 11, 2006

(65) Prior Publication Data

US 2008/0035384 A1 Feb. 14, 2008

(51) Int. Cl.
*E21B 10/36* (2006.01)

(52) U.S. Cl. ..... 175/420.1; 175/435

(58) Field of Classification Search ..... 175/435, 175/420.1, 432, 433, 426
See application file for complete search history.

(56) References Cited

U.S. PATENT DOCUMENTS 3,970,158 A 7/1976 Black et al.
4,873,895 A * 10/1989 Taylor et al. ..... 76/108.2
5,467,669 A * 11/1995 Stroud ..... 76/108.2
2005/0087371 A1* 4/2005 Kembaiyan ..... 175/435

* cited by examiner

*Primary Examiner*—Hoang Dang
(74) *Attorney, Agent, or Firm*—WRB-IP LLP

(57) ABSTRACT

A rock drilling bit includes at least one button having a button sidewall and button bottom, the button sidewall and the button bottom having a button sidewall geometry and a button bottom geometry, respectively. The rock drilling bit further comprises a bit body having at least one button-receiving hole having a hole sidewall and a hole bottom, the hole sidewall and the hole bottom having a hole sidewall geometry complementary to the button sidewall geometry and a hole bottom geometry, and a deformable seat compressed between the buttom bottom and the hole bottom so that the seat conforms to a hole bottom geometry and the button bottom geometry. The seat comprises tin.

18 Claims, 2 Drawing Sheets

TIN SEAT FOR ROCK DRILL INSERT

BACKGROUND AND SUMMARY

The present invention relates to seats for rock drill inserts and, more particularly, to seats made largely of tin.

In many rock drills, hard metal inserts, usually made of cemented carbide, are installed in holes in rock drill bit bodies and retained in the holes substantially by an interference fit. U.S. Pat. No. 3,970,158, which is incorporated by reference, discloses an embodiment of such a rock drill with a cemented carbide insert.

In the past, a lead sphere was inserted in the hole prior to installation of the insert. The lead sphere would be compressed by the insert to deform and form a seat for the insert, and would substantially fill any void between the bottom of the insert and the bottom of the hole. In this way, impact would be effectively transmitted from the bit body to the face of the insert through the deformed lead seat. Also, the lead seat would tend to distribute stresses around the hole bottom geometry, reducing a potential of damage to the bit body.

The use of lead as the seat material is problematic. Environmental regulations can make it difficult to dispose of used rock drills or seats for such rock drills. It is desirable to provide an alternative to using lead seats for rock drill inserts.

In accordance with an aspect of the present invention, a rock drilling bit comprises at least one button having a button sidewall and button bottom, the button sidewall and the button bottom having a button sidewall geometry and a button bottom geometry, respectively. The rock drilling bit further comprises a bit body having at least one button-receiving hole having a hole sidewall and a hole bottom, the hole sidewall and the hole bottom having a hole sidewall geometry complementary to the button sidewall geometry and a hole bottom geometry, and a deformable seat compressed between the buttom bottom and the hole bottom so that the seat conforms to a hole bottom geometry and the button bottom geometry, the seat comprising tin.

In accordance with another aspect of the present invention, a seat for a rock drilling button of a rock drilling bit comprises at least about 50% tin and has a volume adapted to completely fill a void between a bottom of a hole in a rock bit body and a bottom of the button when the button is properly positioned relative to the hole and compresses the seat.

In accordance with yet another aspect of the present invention, a method of mounting a button in a button-receiving hole of a rock drilling bit comprises inserting a deformable seat comprising at least 50% tin in a bottom of the hole, and compressing the seat between a bottom of the button and the bottom of the hole so that the seat completely conforms to a hole bottom geometry and a button bottom geometry.

BRIEF DESCRIPTION OF THE DRAWINGS

The features and advantages of the present invention are well understood by reading the following detailed description in conjunction with the drawings in which like numerals indicate similar elements and in which.

DETAILED DESCRIPTION

Figure 1A:
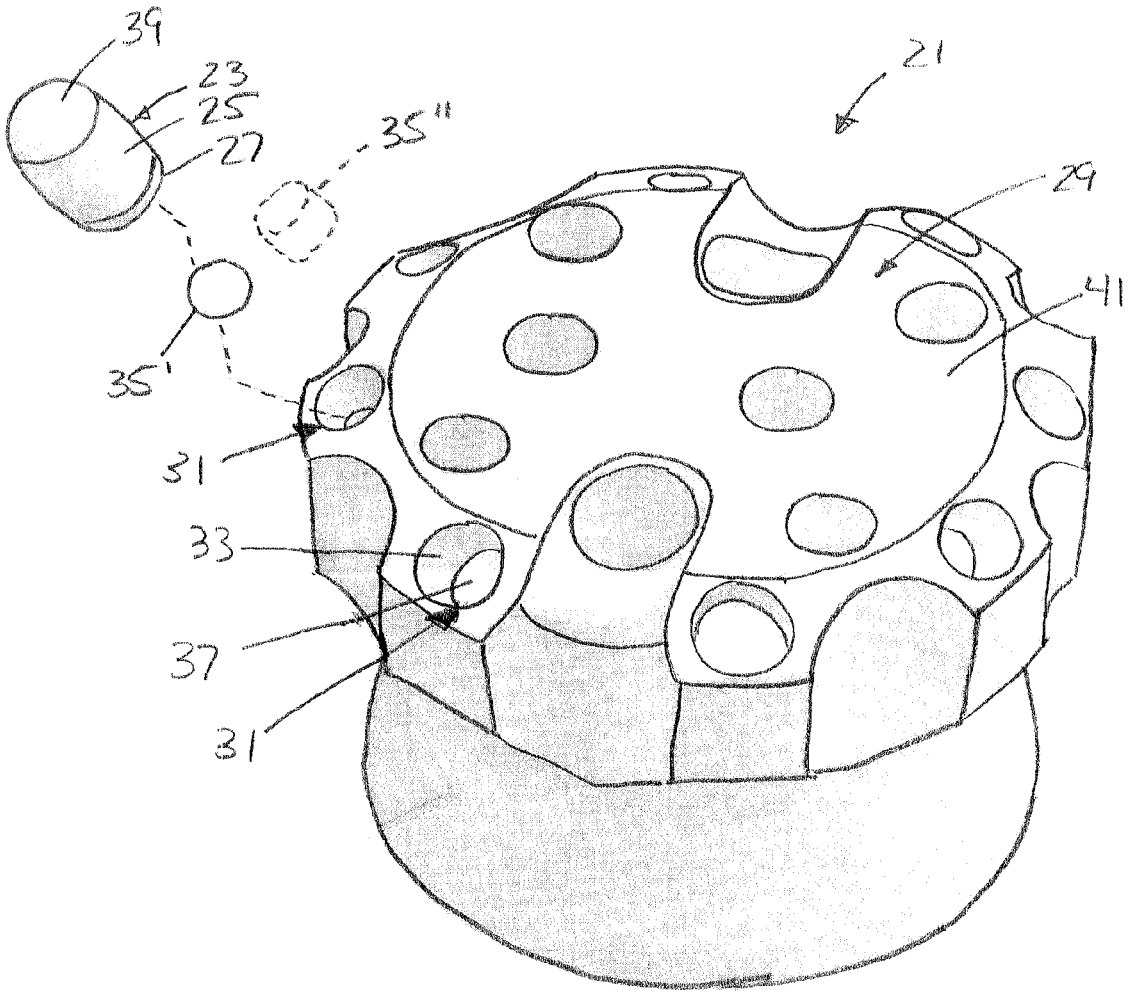
FIG. 1A is a perspective, exploded view of a portion of a rock drilling bit according to an embodiment of the present invention.
Figure 1B:
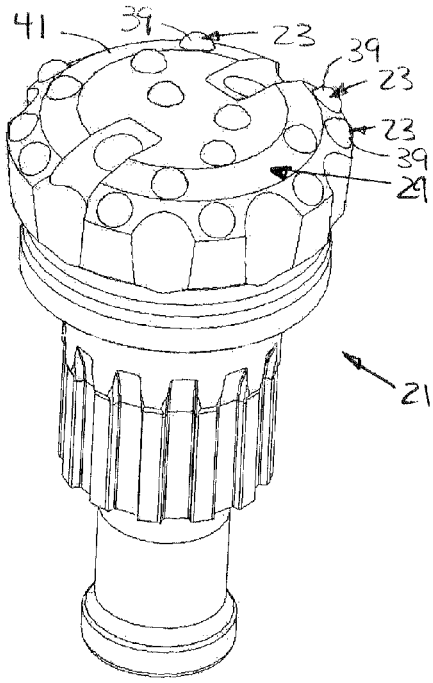
FIG. 1B is a perspective view of a rock drilling bit of the general type shown in FIG. 1A in assembled form.

A rock drilling bit 21 for a rotary percussive rock drill according to an embodiment of the present invention is shown in FIGS. 1A and 1B. FIG. 1A shows the bit 21 with its component parts in an exploded fashion, i.e., prior to assembly, and FIG. 1B shows a bit with its component parts assembled in substantially a final form.

The bit 21 comprises at least one and generally a plurality of buttons 23. The buttons are typically made of a hard material such as cemented carbide and have a sidewall 25 and a bottom 27 having sidewall and bottom geometries, respectively.

The bit 21 also comprises a bit body 29 having at least one and generally a plurality of button-receiving holes 31 equal in number to the number of buttons 23. Each hole 31 has a hole sidewall 33 with a hole sidewall geometry complementary to the button sidewall geometry. There is typically a clearance of about 0.002" between the hole sidewall 33 and the button sidewall 25 and the button 23 tends to be retained in the hole 31 by an interference fit between the hole sidewall and the button sidewall.

The bit 21 further comprises a deformable seat 35 disposed in a bottom 37 of the hole 31 and compressed between the bottom 27 of the button 23 and the bottom of the hole in such a way as to substantially completely conform to a hole bottom geometry and the button bottom geometry. The seat 35 comprises tin, ordinarily at least between about 50-100% tin, more preferably between about 70-100% tin, and still more preferably between about 95-100% tin. The tin in its pure state typically has a Brinell hardness of about 3.9, an ultimate tensile strength of about 220 MPa, a Modulus of Elasticity of about 41.4 GPa, a Poissons Ratio of about 0.33, and a shear modulus of about 15.6 GPa. In addition to tin, the seat 35 may comprise one or more of lead, bismuth, antimony, aluminum, silver, and copper, although it is likely that other materials can be used as well.

Figure 2A:
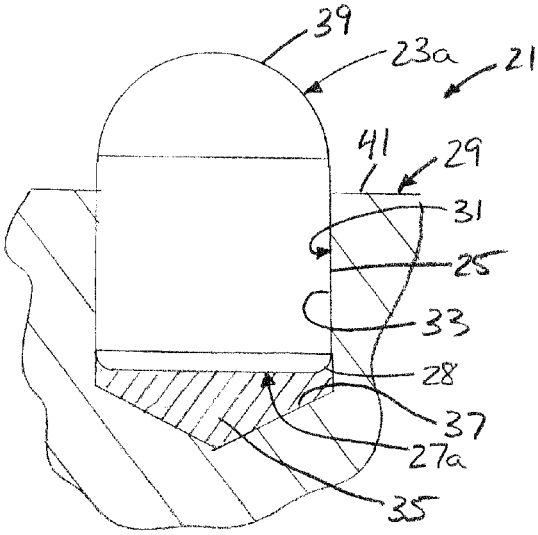
FIGS. 2A, 2B, and 2C are side views of buttons for use with a rock drilling bit according to embodiments of the present invention.
Figure 2B:
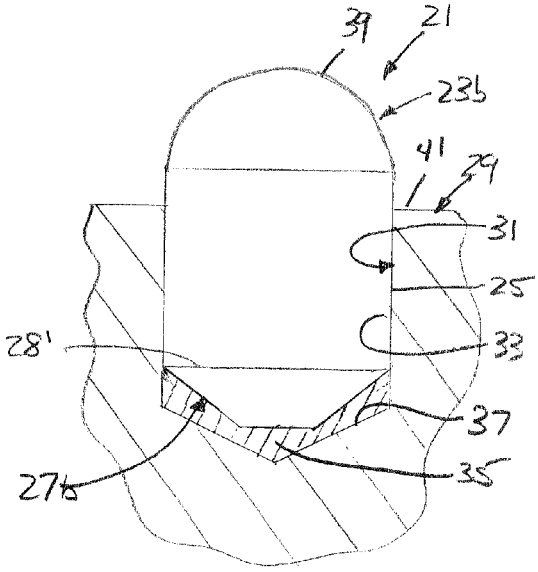
Figure 2C:
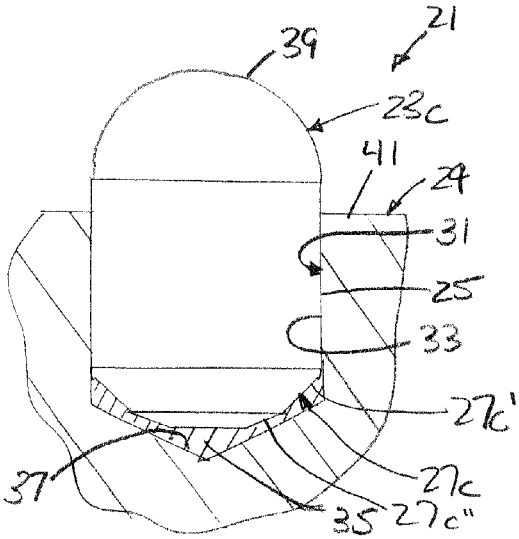

Various button bottom 27 geometries can be provided. Illustrative types of button bottom geometries comprise any of a bottom 27*a* with of substantially flat with a radiused corner 28 for the button 23*a* as seen in FIG. 2A, a bottom 27*b* which may be substantially conical with a radiused corner or, as shown for the button 23*b* in FIG. 2B, with a sharp transition defining a line 28' where the button bottom meets the button sidewall geometry. The conical shape can extend to a point or, as shown in FIGS. 2B and 2C, can be a truncated cone. Of course, variations from these basic shapes can also be provided, such as the bottom 27*c* with a conical shape shown in the button 23*c* of FIG. 2C showing cone sections 27*c*' and 27*c*" having different cone angles.

Prior to compression, the seat 35 will ordinarily have a geometry that is either substantially spherical as seen by the uncompressed seat 35' in FIG. 1A, or substantially cylindrical, as seen by the uncompressed seat 35" shown in phantom in FIG. 1A. The cylindrical seat 35" may be made in any suitable fashion, such as by being cut from a larger cylindrical rod or wire (not shown).

The bit body 29 ordinarily has a hardness of about 38-44 Rockwell C. The button 23 ordinarily has a hardness of about 89-94 Rockwell A. The seat 35 typically has a hardness of about 3.9 Brinell (for pure tin) to about 6.2 Brinell for alloys. The physical properties of the seat 35 will be such that it can deform and substantially fully conform to the space between the hole bottom 37 and the button bottom 27 when normal forces for seating a button in a hole and deforming known seats, usually about 4500-7500 psi, are applied. The volume of the seat 35 will ordinarily be calculated so that, when it completely fills a void between the hole bottom and the button bottom, the button will be properly positioned relative to the hole, such as by having its working face 39 at a predetermined distance above a surface 41 of the bit body 29. While the size of a seat 35 will typically depend upon factors such as the size and shape of the hole 31 and the button 23, the seat typically has a volume in the range of about 0.017 to 0.070 $in^3$ (0.28 to 1.15 $cm^3$).

In a method of mounting a button 23 in a button-receiving hole 31 of a rock drilling bit 21, a deformable seat 35 comprising at least 50% tin is inserted in a bottom 37 of the hole. The seat 35 is compressed between a bottom 27 of the button 23 and the bottom 37 of the hole 31 so that the seat completely conforms to a hole bottom geometry and a button bottom geometry and completely fills a void between the hole bottom and the button bottom.

By providing a seat 35 formed entirely or largely of tin, adverse environmental effects of the seat after use can be minimized, particularly when compared with lead seats. In addition, a seat 35 formed entirely or largely of tin is relatively easy to deform to fill the void between the hole bottom 37 and the button bottom 27. In this way, the seat 35 can effectively transfer impact energy from a percussion hammer through the bit body 29 and thus to the working face 39 of the button 37 to facilitate fracturing of hard rock in drilling applications. In addition, because the seat 35 formed entirely or largely of tin is relatively easy to deform to fill the void between the hole bottom 37 and the button bottom 27, impact stresses will tend to be more evenly distributed between the button 23 and the bit body 29 and will have less of a tendency to fatigue hole corners and crack, leading to bit failure.

In the present application, the use of terms such as "including" is open-ended and is intended to have the same meaning as terms such as "comprising" and not preclude the presence of other structure, material, or acts. Similarly, though the use of terms such as "can" or "may" is intended to be open-ended and to reflect that structure, material, or acts are not necessary, the failure to use such terms is not intended to reflect that structure, material, or acts are essential. To the extent that structure, material, or acts are presently considered to be essential, they are identified as such.

While this invention has been illustrated and described in accordance with a preferred embodiment, it is recognized that variations and changes may be made therein without departing from the invention as set forth in the claims.

What is claimed is:

1. A rock drilling bit, comprising:

at least one button having a button sidewall and button bottom, the button sidewall and the button bottom having a button sidewall geometry and a button bottom geometry, respectively;

a bit body having at least one button-receiving hole having a hole sidewall and a hole bottom, the hole sidewall and the hole bottom having a hole sidewall geometry complementary to the button sidewall geometry and a hole bottom geometry;

a deformable seat compressed between the button bottom and the hole bottom so that the seat conforms to a hole bottom geometry and the button bottom geometry, the seat comprising tin, wherein the seat is compressed from a geometry that is one of substantially spherical and substantially cylindrical.

2. The rock drilling bit as set forth in claim 1, wherein the seat comprises at least one of lead, bismuth, antimony, aluminum, silver, and copper.

3. The rock drilling bit as set forth in claim 1, wherein the button bottom geometry comprises one of substantially flat with a radiused comer, substantially conical with a radiused corner, and substantially conical and meeting the button sidewall geometry along a circumferential line.

4. The rock drilling bit as set forth in claim 1, wherein the bit body has a hardness of about 38-44 Rockwell C.

5. The rock drilling bit as set forth in claim 1, wherein the button has a hardness of about 89-94 Rockwell A.

6. The rock drilling bit as set forth in claim 1, wherein the seat has a hardness of about 3.9-6.2 Brinell.

7. The rock drilling bit as set forth in claim 6, wherein the bit body has a hardness of about 38-44 Rockwell C.

8. The rock drilling bit as set forth in claim 7, wherein the button has a hardness of about 89-94 Rockwell A.

9. The rock drilling bit as set forth in claim 6, wherein the button has a hardness of about 89-94 Rockwell A.

10. A rock drilling bit, comprising:

at least one button having a button sidewall and button bottom, the button sidewall and the button bottom having a button sidewall geometry and a button bottom geometry, respectively;

a bit body having at least one button-receiving hole having a hole sidewall and a hole bottom, the hole sidewall and the hole bottom having a hole sidewall geometry complementary to the button sidewall geometry and a hole bottom geometry;

a deformable seat compressed between the button bottom and the hole bottom so that the seat conforms to a hole bottom geometry and the button bottom geometry, the seat comprising tin, wherein the seat comprises between about 50-100% tin.

11. The rock drilling bit as set forth in claim 10, wherein the seat comprises between about 70-100% tin.

12. The rock drilling bit as set forth in claim 11, wherein the seat comprises between about 95-100% tin.

13. A seat for a rock drilling button of a rock drilling bit, the seat comprising at least about 50% tin and having a volume adapted to completely fill a void between a bottom of a hole in a rock bit body and a bottom of the button when the button is properly positioned relative to the hole and compresses the seat.

14. The seat as set forth in claim 13, wherein the seat has a hardness of about 3.9-6.2Brinell.

15. The seat as set forth in claim 13, wherein the seat comprises between about 70-100% tin.

16. The seat as set forth in claim 15, wherein the seat comprises between about 95-100% tin.

17. The seat as set forth in claim 16, wherein the seat comprises at least one of lead, bismuth, antimony, aluminum, silver, and copper.

18. A method of mounting a button in a button-receiving hole of a rock drilling bit, comprising:

inserting a deformable seat comprising at least 50% tin in a bottom of the hole; and compressing the seat between a bottom of the button and the bottom of the hole so that the seat completely conforms to a hole bottom geometry and a button bottom geometry.

* * * * *